US008081734B2

(12) United States Patent
Elam et al.

(10) Patent No.: US 8,081,734 B2
(45) Date of Patent: Dec. 20, 2011

(54) MINIATURE, LOW-POWER X-RAY TUBE USING A MICROCHANNEL ELECTRON GENERATOR ELECTRON SOURCE

(75) Inventors: Wm. Timothy Elam, Redmond, WA (US); Warren C. Kelliher, Hampton, VA (US); William Hershyn, Soquel, CA (US); David P. DeLong, Soquel, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 87 days.

(21) Appl. No.: 12/628,446

(22) Filed: Dec. 1, 2009

(65) Prior Publication Data

US 2010/0195801 A1 Aug. 5, 2010

Related U.S. Application Data

(60) Provisional application No. 61/119,043, filed on Dec. 2, 2008.

(51) Int. Cl.
*H01J 35/00* (2006.01)

(52) U.S. Cl. ..... 378/121; 378/136

(58) Field of Classification Search ..... 378/119, 378/121, 122, 124, 134, 136
See application file for complete search history.

(56) References Cited

U.S. PATENT DOCUMENTS

| | | | | |
|---|---|---|---|---|
| 4,870,671 | A | 9/1989 | Hershyn | |
| 5,504,796 | A * | 4/1996 | Da Silveira et al. | 378/121 |
| 6,057,637 | A | 5/2000 | Zettl et al. | |
| 6,239,549 | B1 | 5/2001 | Laprade | |
| 6,259,765 | B1 | 7/2001 | Baptist | |
| 6,333,968 | B1 | 12/2001 | Whitlock et al. | |
| 6,459,767 | B1 | 10/2002 | Boyer | |
| 6,553,096 | B1 | 4/2003 | Zhou et al. | |
| 6,661,876 | B2 | 12/2003 | Turner et al. | |
| 6,711,234 | B1 | 3/2004 | Loxley et al. | |
| 6,850,595 | B2 | 2/2005 | Zhou et al. | |
| 7,375,359 | B1 | 5/2008 | Grodzins | |
| 2002/0191746 | A1 | 12/2002 | Dinsmore | |
| 2003/0002627 | A1 | 1/2003 | Espinosa et al. | |
| 2003/0048877 | A1 | 3/2003 | Price et al. | |

(Continued)

OTHER PUBLICATIONS

Bruce N. Laprade et al., "The Development of a Novel, Cold Electron Source," ASMS Conference, Jun. 2002, Orlando, Florida.

*Primary Examiner* — Courtney Thomas
(74) *Attorney, Agent, or Firm* — Andrea Z. Warmbier; Helen M. Galus

(57) ABSTRACT

Embodiments of the invention provide a novel, low-power X-ray tube and X-ray generating system. Embodiments of the invention use a multichannel electron generator as the electron source, thereby increasing reliability and decreasing power consumption of the X-ray tube. Unlike tubes using a conventional filament that must be heated by a current power source, embodiments of the invention require only a voltage power source, use very little current, and have no cooling requirements. The microchannel electron generator comprises one or more microchannel plates (MCPs), Each MCP comprises a honeycomb assembly of a plurality of annular components, which may be stacked to increase electron intensity. The multichannel electron generator used enables directional control of electron flow. In addition, the multichannel electron generator used is more robust than conventional filaments, making the resulting X-ray tube very shock and vibration resistant.

17 Claims, 10 Drawing Sheets

U.S. PATENT DOCUMENTS

| | | | |
|---|---|---|---|
| 2005/0129178 | A1 | 6/2005 | Pettit |
| 2005/0226373 | A1 | 10/2005 | Trombka et al. |
| 2005/0232392 | A1 | 10/2005 | Bradley et al. |
| 2006/0098779 | A1 | 5/2006 | Turner |
| 2006/0233307 | A1 | 10/2006 | Dinsmore |
| 2007/0215841 | A1 | 9/2007 | Ford et al. |

* cited by examiner

MINIATURE, LOW-POWER X-RAY TUBE USING A MICROCHANNEL ELECTRON GENERATOR ELECTRON SOURCE

This application claims the benefit of U.S. Provisional Application No. 61/119,043, filed Dec. 2, 2008.

The invention was made in part by employees of the United States Government and may be manufactured and used by or for the Government of the United States of America for governmental purposes without the payment of any royalties thereon or therefor.

ORIGIN OF THE INVENTION

1. Field of the Invention

The present invention relates generally to X-ray tubes, and, more particularly, relates to electron generators for X-ray tubes.

2. Background

X-ray tubes still operate in basically the same way as the original hot cathode tubes invented in 1913. A diagram of a prior art X-ray tube 10 is shown in FIG. 1. Electrons from a filament 12 are accelerated by a high voltage and strike an anode. The energetic electrons 14 excite atoms of the anode 16, which then emit their characteristic X-rays 20. Typical anodes are tungsten, copper, silver, rhodium, and molybdenum. Other anodes may be employed for specific applications. The X-rays are emitted through a window 18 (typically constructed of beryllium), in a sealed vacuum chamber 22.

The source of the electrons is almost always a heated filament made of a tungsten wire that gives off electrons by thermionic emission. The filament is resistively heated by passing a low-voltage current through the wire. The electron emission current is regulated by adjusting the filament heating power based on feedback from the output current of the high voltage power supply. The electron emission and acceleration must occur in a high vacuum, so the X-ray tube is typically constructed in a metal and insulator housing with a thin window through which the X-rays can escape.

There are two processes that require power in an X-ray tube. The first is the power to accelerate the electrons, which is the power used to generate the X-rays. This process is governed by its basic physics and there is little or no possibility of improving it. However, the electron source also requires power to generate the electrons. In a conventional X-ray tube, this is the filament heating power. Even the smallest X-ray tubes require at least one-quarter watt for this purpose, and often much more (2 to 3 watts is more typical). For a miniature X-ray tube, the accelerating power (accelerating voltage times emission current) is typically about one watt and could be much less in some applications. So the filament heating power is a substantial part of the total power requirement and reducing it would significantly reduce the power required to operate an X-ray tube. Power consumption in X-ray tubes is particularly important for emerging applications in spacecraft instruments for planetary exploration and in hand-held analyzers.

The main failure component and therefore the main limitation of the lifetime, ruggedness, and reliability of X-ray tubes is the thermionic filament which serves as the source of electrons. The filament must be small to reduce the power used to heat it, which makes it delicate and subject to mechanical failure. It can also be degraded by poor vacuum in the sealed tube.

Replacing the thermionic filament with a more reliable and efficient electron source would increase the reliability and reduce the power consumption of an X-ray tube dramatically.

This would enable the construction of elemental analysis sensors with low power consumption that would still provide performance near what is achievable in the laboratory. This opens up new possibilities for sensors and applications for sensing systems.

BRIEF SUMMARY

Embodiments of the invention provide a novel, low-power X-ray tube and X-ray generating system. Embodiments of the invention use a multichannel electron generator as the electron source, thereby increasing reliability and decreasing power consumption of the X-ray tube. Unlike tubes using a conventional filament that must be heated by a current power source, embodiments of the invention require only a voltage power source, use very little current, and have no cooling requirements. The multichannel electron generator used enables directional control of electron flow. In addition, the multichannel electron generator used is more robust than conventional filaments, making the resulting X-ray tube very shock and vibration resistant. Embodiments of the invention thereby enable the production of novel analytical sensors for space and terrestrial applications.

In at least one embodiment of the invention, an X-ray generating system comprises an X-ray tube and a power supply. The X-ray tube comprises a microchannel electron generator, an anode positioned such that a stream of electrons generated by the electron generator impinge upon the anode, a sealed vacuum enclosure containing the electron generator and anode, and a window defined in the enclosure. The power supply supplies power to the electron generator.

The microchannel electron generator may comprise a honeycomb assembly of a plurality of annular components, and may comprise two or more honeycomb assemblies in a stacked configuration. The annular components may be constructed from one of metal, ceramic, and glass.

The anode may comprise a tungsten anode, and may be positioned at approximately a 40 degree angle to the electron stream. The window may comprise a beryllium window. The power supply may be configured for providing a drive voltage of up to about 3 kilovolts at 50 microamperes for the microchannel electron generator as well as a higher voltage to accelerate the electron beam for X-ray production.

In addition to the X-ray generating system, as described above, other aspects of the present invention are directed to X-ray tubes.

BRIEF DESCRIPTION OF THE SEVERAL VIEWS OF THE DRAWINGS

Figure 1:
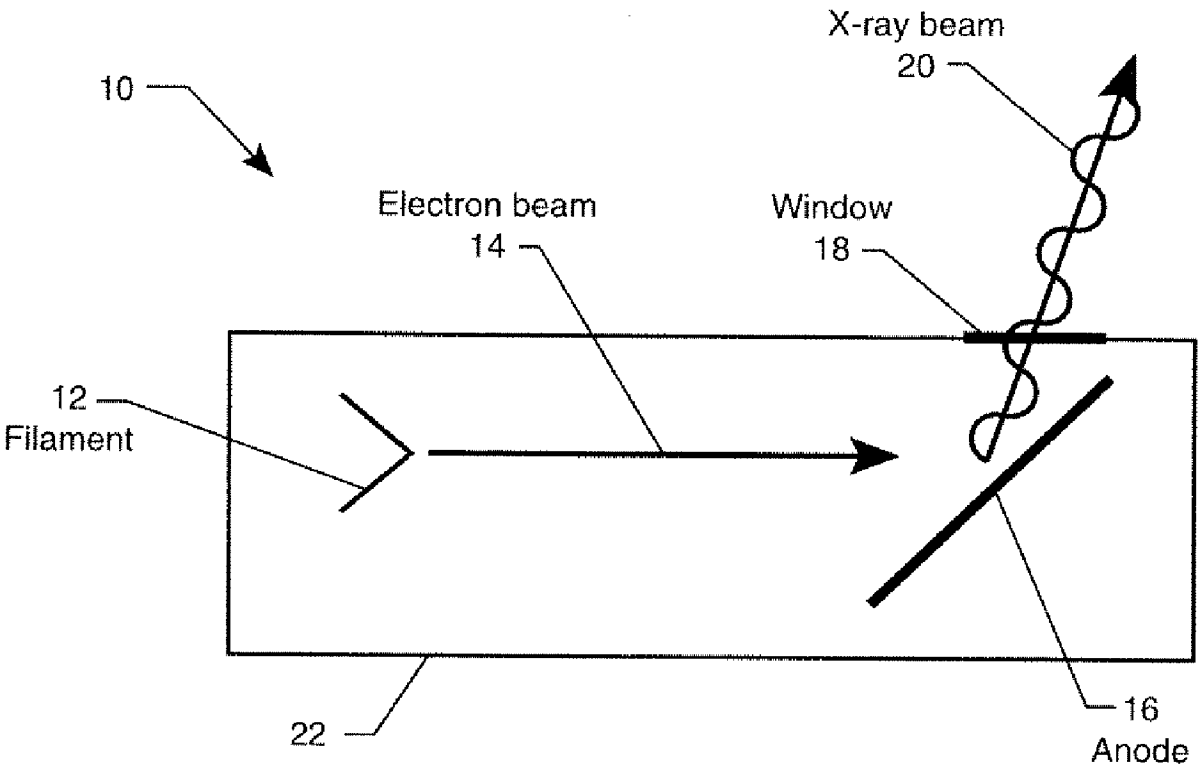
Fig. 1 (Prior Art)
Figure 2:
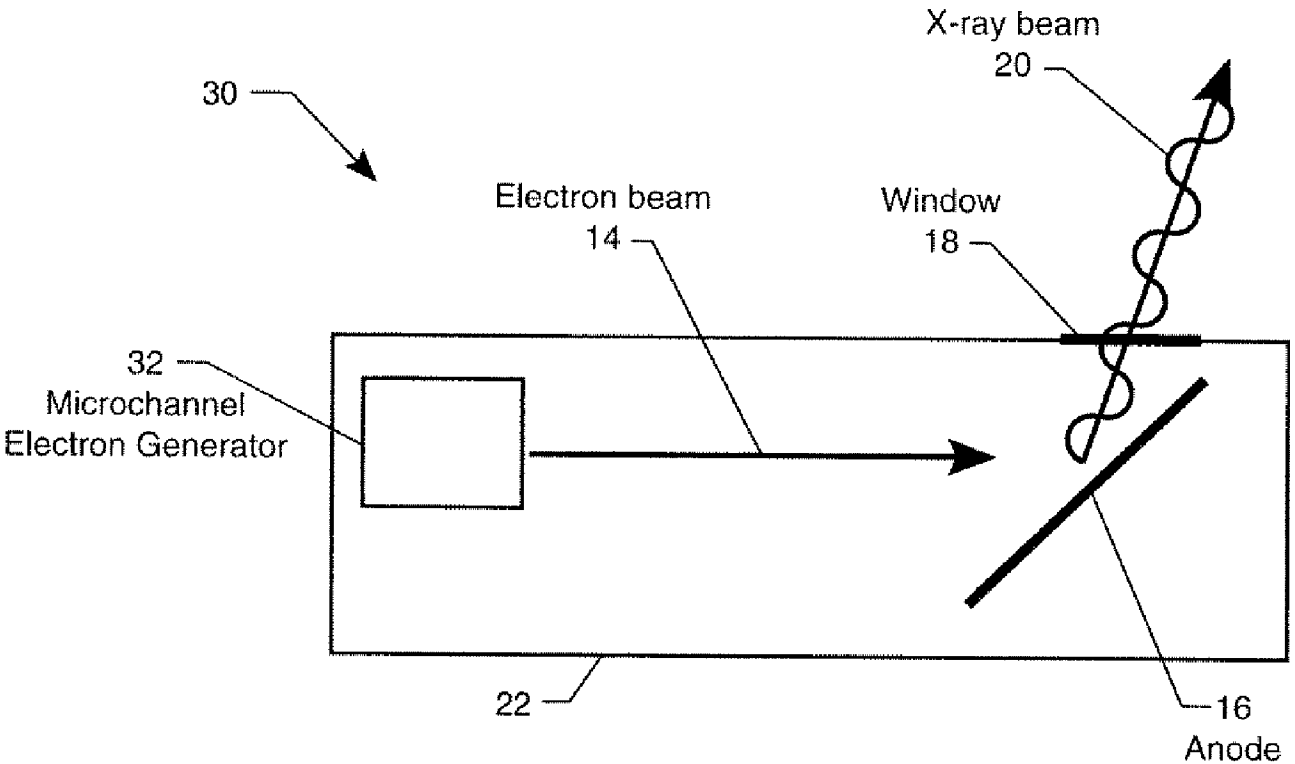
Figure 4:
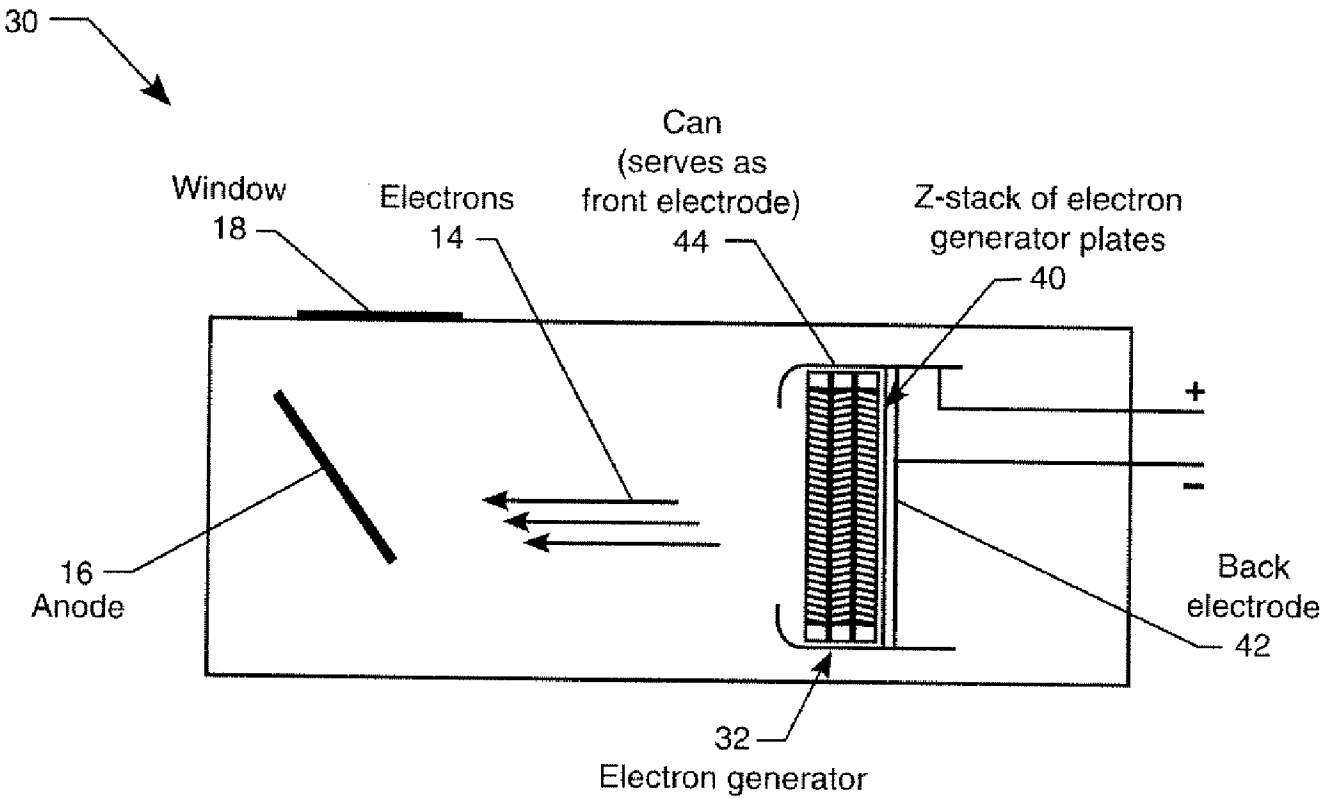
Figure 5:
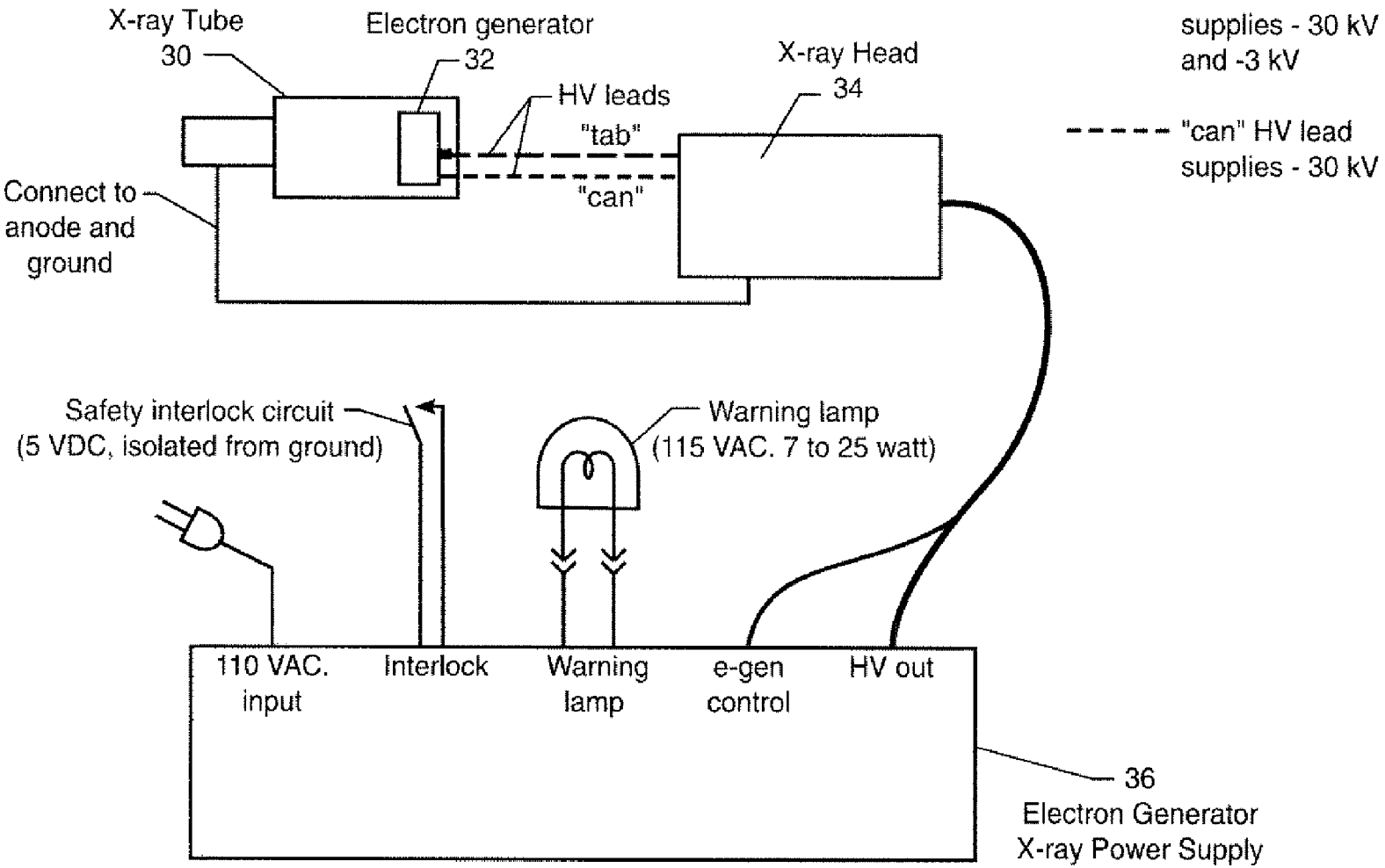
Figure 6:
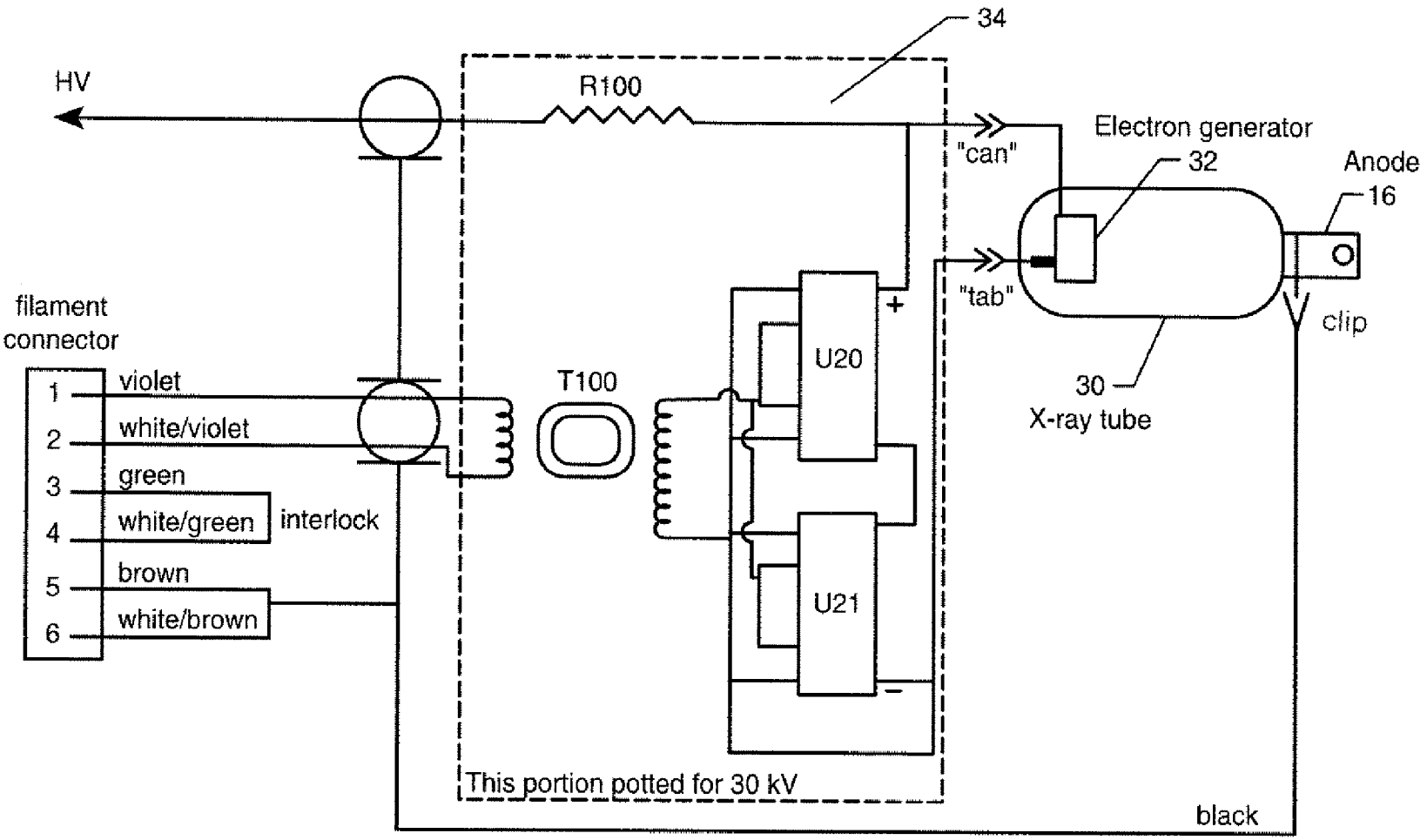
Figure 7:
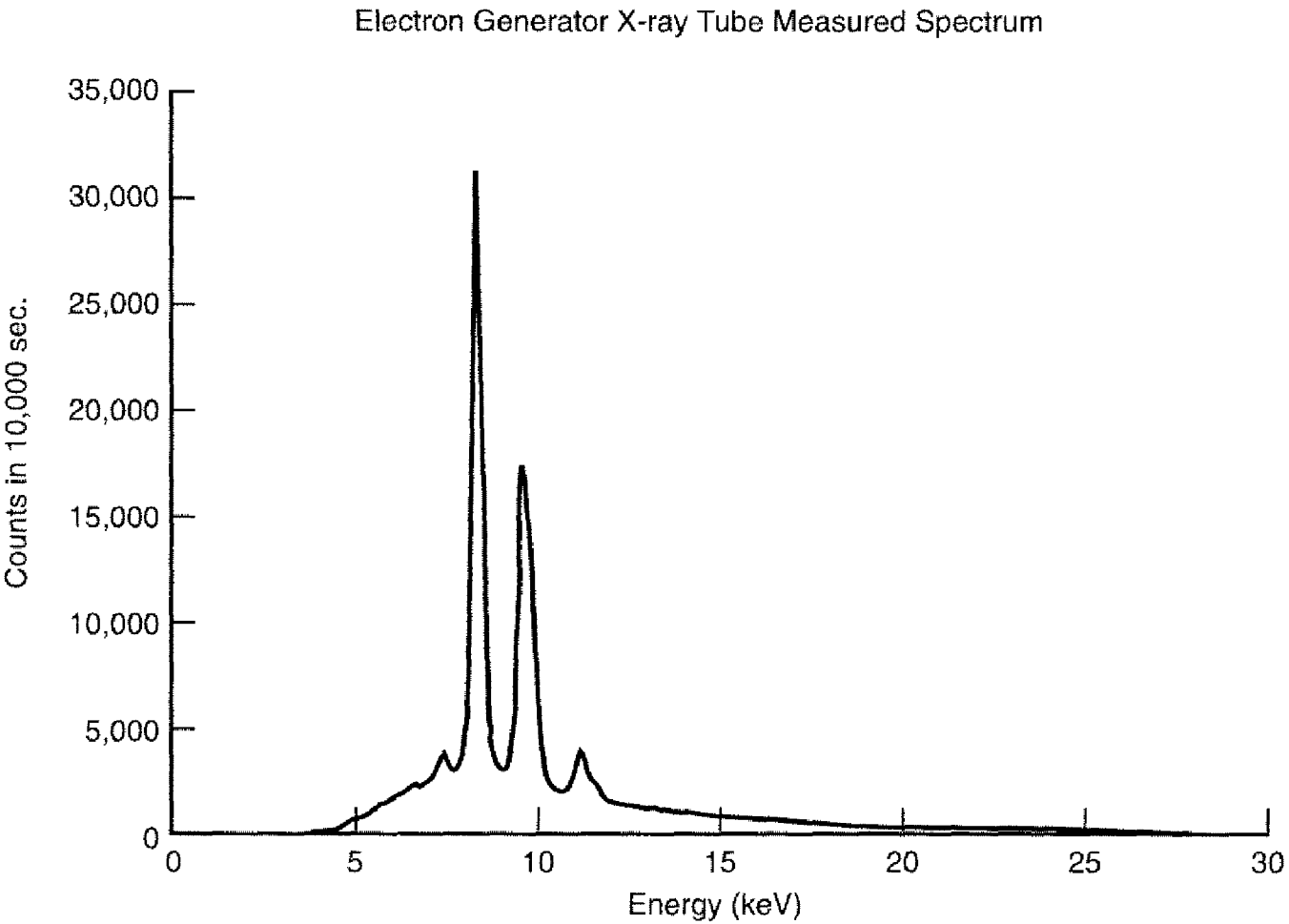
Figure 8:
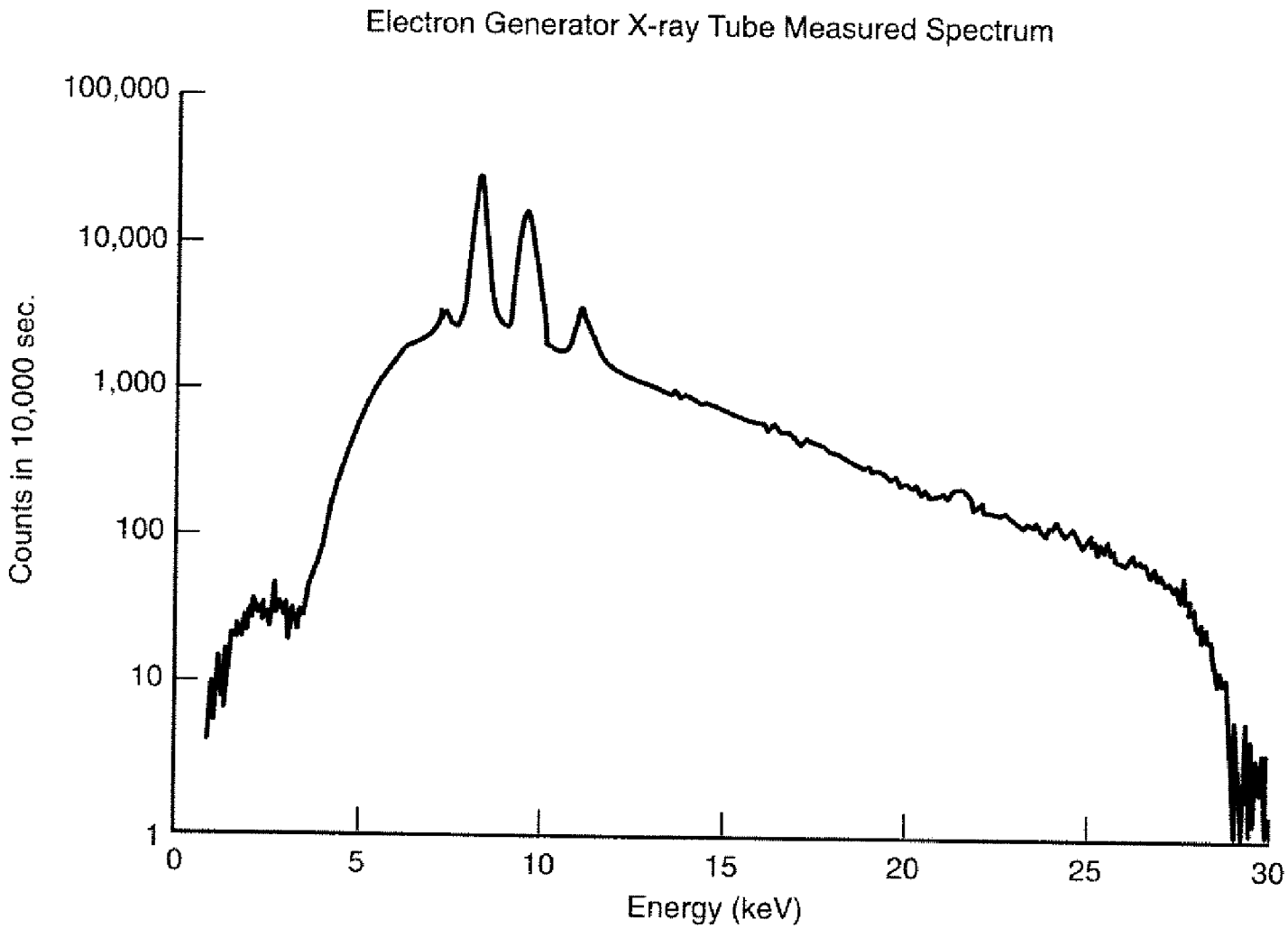
Figure 9:
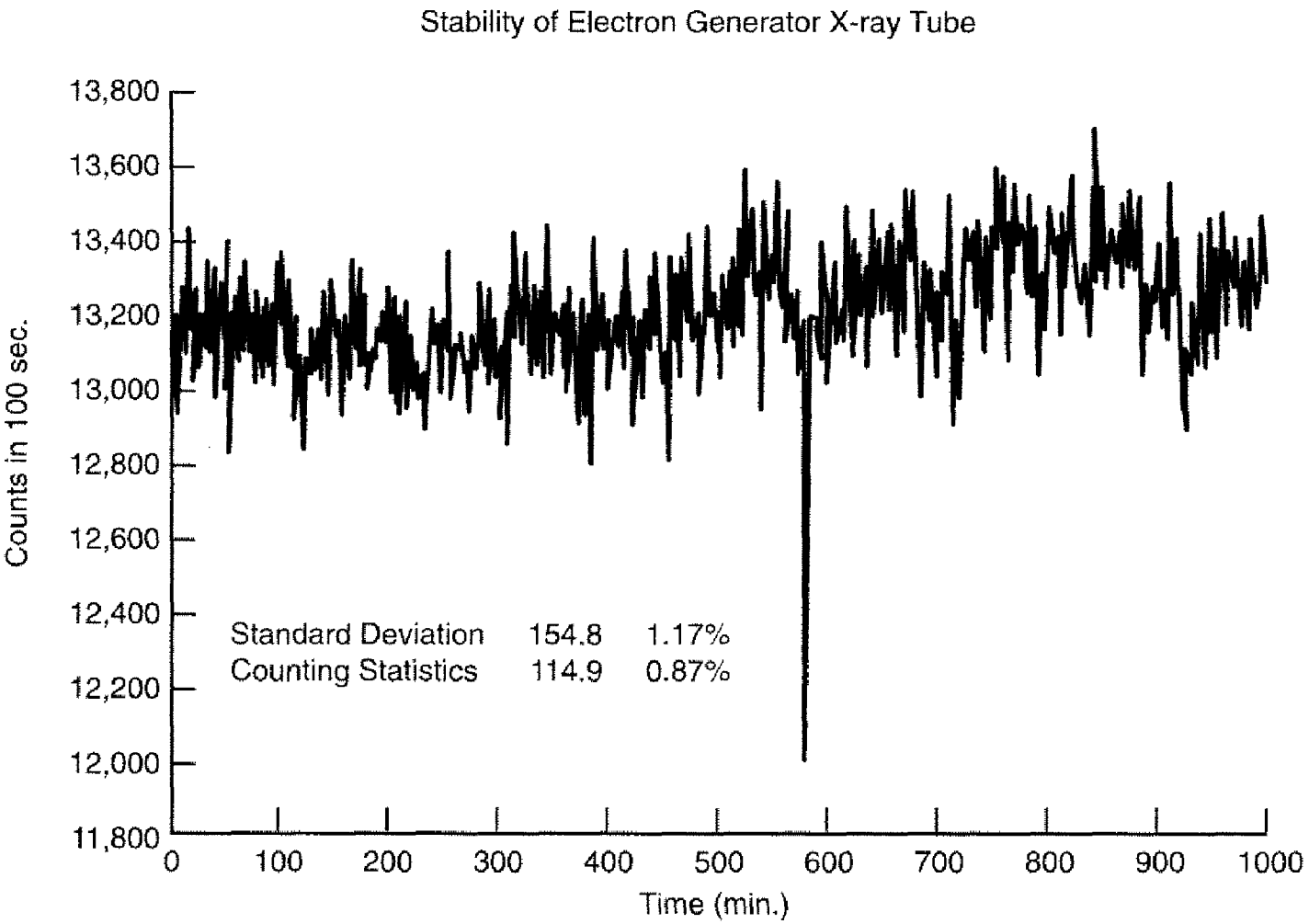
Figure 10:
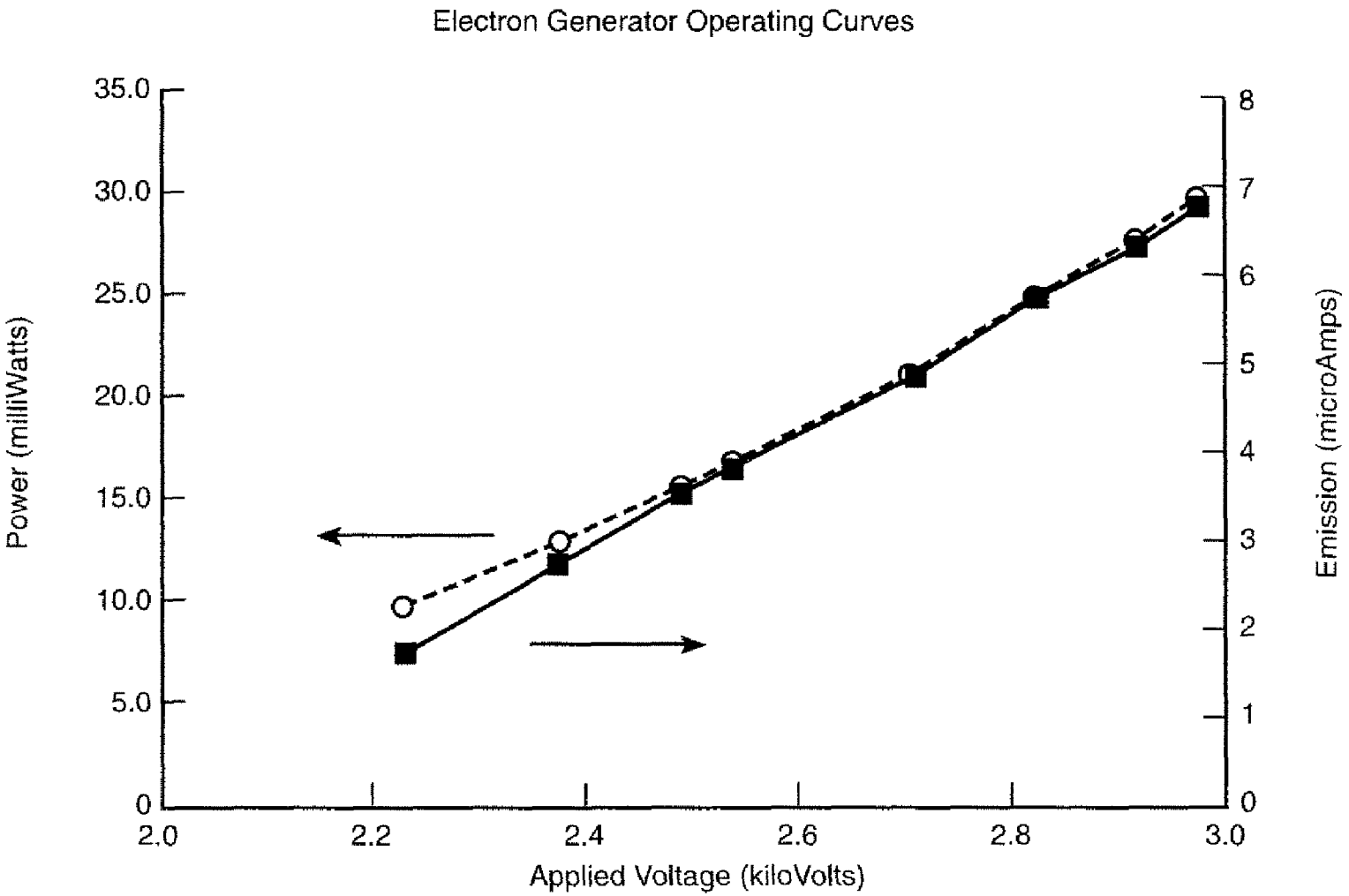

Having thus described the invention in general terms, reference will now be made to the accompanying drawings, which are not necessarily drawn to scale, and wherein:

FIG. 1 is a block diagram of an X-ray tube according to the prior art;

FIG. 2 is a simplified block diagram of an X-ray tube, in accordance with embodiments of the present invention;

FIG. 3 illustrates three microchannel plate configurations of a microchannel electron generator of the X-ray tube of FIG. 2;

FIG. 4 illustrates additional detail of the X-ray tube of FIG. 2;

FIG. 5 is a block diagram of an X-ray generating system using the X-ray tube of FIG. 2;

FIG. 6 is a simplified electrical schematic of the X-ray generating system of FIG. 3;

FIG. 7 illustrates the output spectrum on a linear scale of an X-ray generating system, in accordance with embodiments of the present invention;

FIG. 8 illustrates the output spectrum on a logarithmic scale of an X-ray generating system, in accordance with embodiments of the present invention;

FIG. 9 illustrates the output stability of an X-ray generating system, in accordance with embodiments of the present invention; and FIG. 10 illustrates the power consumption and current emission of an X-ray generating system, in accordance with embodiments of the present invention.

DETAILED DESCRIPTION

Embodiments of the invention use a multichannel electron generator to construct miniature, low-power X-ray tubes. For example, such a multichannel electron generator is disclosed by U.S. Pat. No. 6,239,549 to Laprade, the contents of which are incorporated herein by reference as if set forth in its entirety. This multichannel electron generator generates sufficient current for X-ray production with very little (much less than 1 watt) power consumption and operates at room temperature, making it less susceptible to vacuum degradation. The power required by the electron generator is much less than a heated filament. The multichannel electron generator requires about 3 kilovolts (kV) at a few microamperes to operate. This is a power of only a few milliwatts. Actual measurements of the power consumed by the multichannel electron generator while operating in the new X-ray tube are described below.

Referring now to FIG. 2, a simplified block diagram of an X-ray tube is illustrated in accordance with embodiments of the present invention. The X-ray tube 30 of FIG. 2 comprises a microchannel electron generator 32, an anode 16 positioned such that a stream of electrons 14 generated by the electron generator impinge upon the anode, a sealed vacuum enclosure 22 containing the electron generator and anode, and a window 18 defined in the enclosure. Electrons from the microchannel electron generator are accelerated by a high voltage and strike the anode. The energetic electrons excite atoms of the anode, which then emit their characteristic X-rays 20. The X-rays are emitted through the window.

Figure 3C:
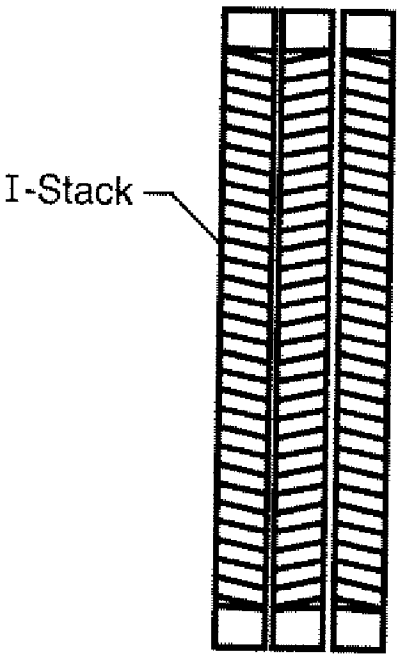
Figure 3B:
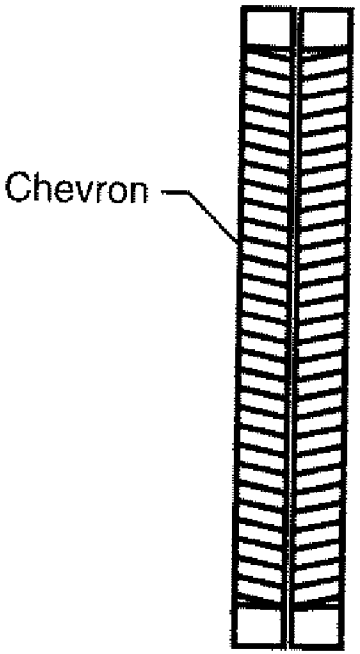
Figure 3A:
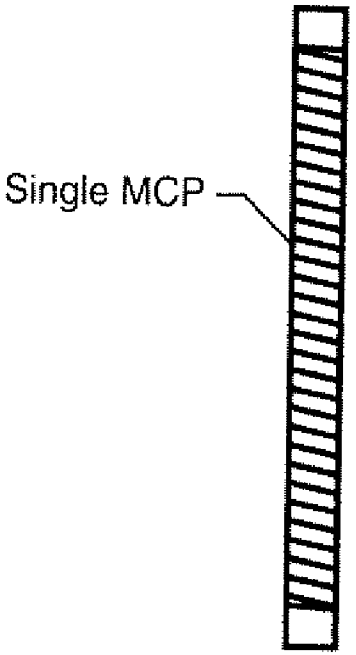

The microchannel electron generator 32 can comprise one or more microchannel plates (MCPs). For example, each MCP can comprise a honeycomb assembly of a plurality of annular components. as described in U.S. Pat. No. 6,239,549. The annular components may be constructed from metal, ceramic, or glass. The annular components are typically positioned at an inclined angle (typically <90 degrees and >45 degrees from the front and back walls of the MCP). One, two, or three MCPs may be used in the microchannel electron generator (if two or more are used, they are in a stacked configuration). FIG. 3 illustrates cross-sectional view of three different microchannel plate configurations of a microchannel electron generator. FIG. 3A shows a single MCP. FIG. 3B shows two MCPs in what is termed a "chevron" configuration, and FIG. 3C shows two MCPs in what is termed a "Z-stack" configuration. As shown in FIGS. 3B and 3C, when two or more MCPs are used the holes in one MCP are aligned (either partially or completely) with the holes in the adjacent MCP to enable electron flow through the MCPs. As also seen in FIGS. 3B and 3C, when two or more MCPs are used they are positioned such that the incline of the holes in one MCP is opposite the incline of the holes in the adjacent MCP. This reversal of the inclines increases electron amplification within the MCPs.

When a voltage is applied across the single MCP or the stack of MCPs, a very small stream of electrons is produced at the back electrode. The MCPs multiply the electrons into a microampere beam of electrons that then exits the front of the microchannel electron generator toward the anode.

FIG. 4 illustrates additional detail of the electron generator 32 of the X-ray tube 30 of FIG. 2. As seen in FIG. 4, the electron generator comprises three MCPs 40 in a "Z-stack" configuration and a back electrode 42, enclosed in a metallic cylinder (termed a "can") 44. A high voltage (typically 3 kV) is applied across the can (which serves as a front electrode) and the back electrode, thereby producing the electrons that are multiplied by the MCPs and exit the front of the electron generator as the electron beam 14.

The X-ray tube of embodiments of the invention would typically be constructed using a sealed glass envelope with a tungsten anode and a beryllium window. This type of tube has proven very effective in miniature terrestrial X-Ray Fluorescence Spectrometer (XRFS) applications. The window may be about 0.005 inch (0.127 mm) thick beryllium. The tube may be arranged in the side-window geometry with the anode placed at a 40 degree angle to allow X-rays to escape out the window.

Referring now to FIGS. 5 and 6, a block diagram and a simplified exemplary electrical schematic of an X-ray generating system are respectively illustrated in accordance with embodiments of the present invention. The X-ray generating system of FIG. 5 comprises an X-ray tube 30 (as described above in relation to FIG. 2), an X-ray head 34, and a power supply 36. As shown, the power supply can provide a high-voltage (HV) drive for the electron generator of up to 3 kV, using two 12-stage voltage multipliers (U20, U21). The supply for this drive voltage is isolated in the X-ray head by transformer T100 so that the electron generator can be biased up to −30 kV to provide accelerating voltage for the electrons. The drive voltage is regulated by the e-gen control signal to the primary of T100 to achieve the desired net emission current in the electron beam, similar to the way the filament is regulated in a conventional X-ray tube. The electron generator drive voltage is arc-protected and is limited to 3 kV and 50 microamperes. The electron generator will typically not produce more than about 5 or 10 microamperes of emission current without exceeding these limits, which are set by the manufacturer. As shown, the accelerating voltage is also arc protected by a 68 k ohm series resistor (R100) in the X-ray head 34 and by the low energy storage design of the HV module. The power supply 36 is a conventional unit powered by a 110 volt AC input and includes a safety interlock and a warning lamp.

The output spectrum and the stability of an X-ray tube of embodiments of the present invention were measured in a laboratory. The spectrum was measured with an energy-dispersive X-ray detector. The energy scale of the detector was calibrated based on the location of the known tungsten X-ray emission lines in the spectrum. The detector gain was adjusted to obtain an energy range from zero to about 35 kV in 1024 channels to insure that the full energy output of the tube was captured. The X-ray tube was operated at 30 kV and 0.9 microamperes for all measurements. The X-ray tube was operated for several days at maximum voltage and current (30 kV and about 5 microamperes) to allow the tube to stabilize.

The spectrum was collected for 10,000 seconds live time and is illustrated in FIG. 7 with a linear scale. FIG. 8 illustrates the output spectrum on a logarithmic scale to better show weaker features. This spectrum is typical of all high-vacuum X-ray tubes, with a continuum background from Bremβtrahlung and the characteristic lines from the anode.

The spectrum of the X-ray tube is determined mainly by the choice of anode and by the accelerating voltage, and secondarily by the exit window material and thickness. In addition to the characteristic emission, the electrons excite a continuous spectrum called bremβtrahlung or "braking radiation." It is produced by deceleration of the electrons in the Coulomb field of the anode atoms. Thus the use of the multichannel electron generator is not expected to have any significant influence on the spectrum from the X-ray tube. The most important secondary performance criterion is the stability of the emission current. Both the spectrum and the stability for the new X-ray tube are evaluated below. Both are comparable to conventional X-ray tubes.

Stability was measured by taking a spectrum for 100 seconds with a one second delay between spectra. The total counts in the spectrum were summed and this sequence of sum counts was plotted in FIG. 9 and analyzed for its average value and standard deviation. The standard deviation was 1.17%, which is comparable to the 2% criterion typical of commercial miniature X-ray tubes. The origin of the anomalous point at 577 minutes is not known. The spectrum did not show any visible differences from the two on either side. This point was not included in the analysis (the standard deviation is 1.23% if this point is included).

The power consumption of the electron generator was measured during normal operation. Voltage measurements were made with a high voltage probe coupled to a digital multimeter. Current measurements were made with the same multimeter. All measurements were made with 10 kV accelerating voltage. The meters for measuring the electron generator parameters were isolated by enclosing them in a polymethylmethacrylate tube to prevent corona currents or arcs to ground from interfering with the measurements. The power consumed by the electron generator for operation of the X-ray tube at 10 kV and 4.8 microamperes emission was 21 milliwatts (2.7 kV applied voltage with 7.9 microamperes of total electron generator current). This very low power confirms the ability of X-ray tubes of embodiments of the present invention to operate with very low power consumption, much less than conventional heated-filament tubes, providing a factor of 10 improvement over even the lowest power conventional X-ray tubes. The emission represents a 61% fraction of the total electron generator current emitted into the usable electron beam. FIG. 10 illustrates curves of both the power consumed (the line with the diamond data points) and the emitted current (the line with the square data points) as a function of the voltage applied to the electron generator. These curves were determined with the X-ray tube in its normal operating configuration and an accelerating voltage of 10 kV, as indicated above.

X-ray tubes of embodiments of the present invention operate very much like a conventional X-ray tube in terms of output. X-ray tubes of embodiments of the present invention consume very little power in producing the electron beam, as expected. The emission current is presently restricted to a few microamperes due to the small size of the electron generator and its low current density.

It may be desirable in some embodiments to use a multichannel electron generator capable of producing a 10 times larger electron beam (or larger). The electron beam can be focused to generate a small beam diameter at the anode of the X-ray tube. Focusing of the electron beam will make the beam diameter much smaller and current density much greater. It may be desirable to force electrons into a smaller focal spot by the same method as used in power klystrons and traveling wave tubes. The spot size of such an X-ray tube will be somewhat dependent on the accelerating voltage. It may be further desirable in some embodiments to continuously evacuate the chamber, such as with an 8 liter/second ion vacuum pump.

Embodiments of the invention provide the following benefits:

- low-power—as the X-ray tube requires only a voltage power source and uses little current;
- small size—as the X-ray tubes can be made in very small sizes, ideal for miniaturization;
- durability—the multichannel electron generator used is much more robust than conventional filaments;
- efficiency—directional control of the electron source provides better efficiency than other X-ray tubes available;
- scalability—the microchannel plates of the multichannel electron generators can be stacked to increase electron intensity; and
- long-life—the multichannel electron generator used has longer lifetime than conventional filaments.

Miniaturization and portability are important in a wide variety of X-ray applications. In addition, the benefits of low power and increased longevity make this technology attractive for standard X-ray systems as well. Potential applications for embodiments of the present invention include:

- analytical sensors, particularly handheld or portable instruments (i.e. mass spectroscopy, X-ray fluorescence);
- medical or dental X-ray equipment;
- airport security;
- inspection of mechanical system integrity; and
- food irradiation in processing plants.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An X-ray generating system comprising:

an X-ray tube, the X-ray tube comprising:

an electron source chosen from the group consisting of a microchannel electron generator;

an anode positioned such that a stream of electrons generated by the electron generator impinge upon the anode;

a sealed vacuum enclosure containing the electron generator and anode; and a window defined in the enclosure; and a power supply for supplying power to the electron generator.

2. The system of claim 1, wherein the microchannel electron generator comprises a honeycomb assembly of a plurality of annular components.

3. The system of claim 2, wherein the microchannel electron generator comprises two or more honeycomb assemblies in a stacked configuration.

4. The system of claim 2, wherein the plurality of annular components are constructed from one of metal, ceramic, and glass.

5. The system of claim 1, wherein the anode comprises a tungsten anode.

6. The system of claim 1, wherein the window comprises a beryllium window.

7. The system of claim 1, wherein the power supply is configured for providing a drive voltage of up to 3 kilovolts at 50 microamperes.

8. The system of claim 1 wherein the anode is positioned at approximately a 40 degree angle to the electron stream.

9. The system of claim 1, wherein the system does not comprise a filament for use as an energy source to generate electrons.

10. The system of claim 1, wherein the power supply is chosen from the group consisting of a voltage power supply.

11. An X-ray tube comprising:

an electron source consisting of a microchannel electron generator;

an anode positioned such that a stream of electrons generated by the electron generator impinge upon the anode;

a sealed vacuum enclosure containing the electron generator and anode; and a window defined in the enclosure.

12. The X-ray tube of claim 11, wherein the microchannel electron generator comprises a honeycomb assembly of a plurality of annular components.

13. The X-ray tube of claim 12, wherein the microchannel electron generator comprises two or more honeycomb assemblies in a stacked configuration.

14. The X-ray tube of claim 12, wherein the plurality of annular components are constructed from one of metal, ceramic, and glass.

15. The X-ray tube of claim 11, wherein the anode comprises a tungsten anode.

16. The X-ray tube of claim 11, wherein the window comprises a beryllium window.

17. The X-ray tube of claim 11, wherein the anode is positioned at approximately a 40 degree angle to the electron stream.

* * * * *